US005530527A

United States Patent [19]

Fukasawa et al.

[11] Patent Number: 5,530,527

[45] Date of Patent: *Jun. 25, 1996

[54] COLOR ELECTROPHOTOGRAPHIC DEVICE WITH DEVELOPER STIRRING

[75] Inventors: Nobuaki Fukasawa; Hiroyuki Tadokoro; Akira Sasaki; Isamu Terashima, all of Hitachi, Japan

[73] Assignee: Hitachi, Ltd., Tokyo, Japan

[ * ] Notice: The term of this patent shall not extend beyond the expiration date of Pat. No. 5,434,652.

[21] Appl. No.: 413,225

[22] Filed: Mar. 30, 1995

Related U.S. Application Data

[63] Continuation of Ser. No. 145,602, Nov. 4, 1993, Pat. No. 5,434,652.

[30] Foreign Application Priority Data

Nov. 16, 1992 [JP] Japan ..... 4-305496

[51] Int. Cl.[6] ..... G03G 15/08; G03G 15/01

[52] U.S. Cl. ..... 355/245; 347/140

[58] Field of Search ..... 355/208, 245, 355/246, 251; 118/645, 657, 658; 347/115, 140, 158

[56] References Cited

U.S. PATENT DOCUMENTS 4,267,201 5/1981 Nakahara et al. ..... 118/658

5,124,751 6/1992 Fukui et al. ..... 355/246

5,353,102 10/1994 Sato et al. ..... 355/246

*Primary Examiner*—Joan H. Pendegrass

*Attorney, Agent, or Firm*—Antonelli, Terry, Stout & Kraus

[57] ABSTRACT

A color electrophtographic printer has: a photosensitive drum on which electrostatic latent images are formed according to print data separated by colors; a plurality of developing units each including a developing powder container accommodating a two component developing powder formed by mixing carriers and toners, an apparatus for agitating the developing powder, and a unit for supplying the toners in the developing powder container; a unit for selecting one of the plurality of developing units according to color to be developed and for activating the same to develope the corresponding electrostatic latent image formed on the photosensitive drum; and a control unit for controlling the respective operations. A control unit is further provided for counting colored print data dots contained in print data for respective colors and for additionally activating the developing powder agitating prior to a subsequent developing operation for any of the developing units which have experienced developing of the electrostatic latent images formed with colored print data dots in excess of a predetermined count.

8 Claims, 5 Drawing Sheets

| BLACKENED RATE | RENEWED VALUE IN COUNTER FOR FORCED AGITATION CONTROL | EXECUTING CONDITION FOR FORCED AGITATION SEQUENCE |
|---|---|---|
| 0~29% | 0 | ACCUMULATED VALUE IN COUNTER AFTER RENEWAL ≧ 4 |
| 30~49% | +1 | |
| 50~100% | +2 | |

*1 COUNTERS ARE PREPARED FOR EVERY TONER COLOR

*2 COUNT OF A COUNTER ALLOCATED FOR A SPECIFIC COLOR TO WHICH FORCED AGITATION HAS BEEN EXECUTED IS RENDERED "0"

COLOR ELECTROPHOTOGRAPHIC DEVICE WITH DEVELOPER STIRRING

This application is a continuation application Ser. No. 08/145,602 filed Nov. 4, 1993, now U.S. Pat. No. 5,434,652.

BACKGROUND OF THE INVENTION

1. Field of the Invention

The present invention relates to a color electrophotographic device, and, in particular, it relates to a color electrophotographic device comprising developing units using a developing powder composed of two components.

2. Description of Related Art

A color electrophotographic device, such as a color laser printer utilizing electrophotographic processes, comprises a photosensitive body on which there is formed electrostatic latent images corresponding to respective print data separated in accordance with colors of an original print A plurality of developing units each including a developing powder container accommodating a two component developing powder formed by mixing carriers and toners, and a developing powder agitating means is used for agitating the developing powder. A toner supplying means supplies the toners into the developing powder container, and a developing unit selecting and activating unit selects one of the developing units depending on a color to be developed and activates the same to develope an electrostatic latent image on the photosensitive body. A control unit provided for overall control of the above-mentioned operations. The toner consumed for the developing operation is supplied into the developing powder container from the toner supplying means.

A major use of a color laser printer is directed to the printing of graphic data. In particular, the frequency of dealing with print data having higher blackened rate, i.e., a high rate of colored dot printing, in comparison with that of text data by the color laser printer is increasing. When an electrostatic latent image of print data having a high blackened rate is developed, the amount of toner consumed in the developing unit increases, which causes a decrease in toner density in the developing powder and an increased frequency of toner supply in the developing unit.

Now, the two component developing powder formed by mixing carriers and toners is explained. Through mixing and agitating of the two component developing powder, the toners are frictionally charged and their deposition on the carriers and the electrostatic latent images is controlled. Accordingly, when the mixing and agitating of the two component developing powder is insufficient, the toners are not charged to a predetermined level, with the result that a desirable developing characteristic can not be achieved. Further, since the toner density is determined by detecting the permiability of the two component developing powder, which varies depending on the toner amount (mixture ratio of toner) deposited on the magnetic carriers via the frictional charge thereof, as a magnitude of inductance of a coil disposed adjacent to the two component developing powder, a correct toner density (a mixture ratio) can not be determined if a predetermined frictional charge is not induced on the toners. Accordingly, a sufficient mixing and agitating of the two component developing powder is indispensable.

When toners are supplied into a developing unit, a shortage in frictional charge of the two component developing powder is caused; however, in the case of a developing unit having a large storage capacity for the developing powder, an amount of the toners supplied in one time is relatively small with respect to the amount of toners under use, so that the influence of the shortage of charges due to the toner supply is insignificant. On the other hand, in case of a small size developing unit having a small storage capacity for the developing powder, the influence of the shortage of charges due to the toner supply is significant.

In particular, in a small size color laser printer necessitating four developing units, it is difficult to enlarge respective developing powder containers, with the result that, after a toner supply in association with print data having a high blackened rate, a shortage in toner charge is induced, which likely causes a defective developement. Further, for maintaining a sufficient mixing and agitating of the developing powder, it has been necessary to interrupt frequently the printing operation for the mixing and agitating operation.

SUMMARY OF THE INVENTION

An object of the present invention is to improve a conventional small size color electrophotographic device having a high demand for reducing the size and weight the developing units included therein so as to prevent a shortage of toner charges caused by insufficient agitation time of the developing powder in the developing unit due to frequent toner supply into the developing unit during frequent prints of print data having a high blackened rate, as well as, to realize a color picture image print of a high quality, while suppressing the printing speed reduction as much as posible.

The color electrophotographic device according to the present invention, has a photosensitive body on which electrostatic latent images are formed corresponding to respective print data separated in accordance with colors of an original print, a plurality of developing units each including a developing powder container accommodating a two component developing powder formed by mixing carriers and toners, a developing powder agitating means for agitating the developing powder and a toner supplying means for supplying the toners into the developing powder container, a developing unit selecting and activating means which selects one of the developing units depending on a color to be developed and activates the same to develope an electrostatic latent image on the photosensitive body, and a control unit for controlling the above mentioned operations, is eliminated from, the control unit is provided with a colored print data measuring means which measures colored print data amounts for respective colors and an additional agitating operation controlling means which increases an activation of the developing powder agitating means for the developing unit, which has performed a development of electrostatic latent images amounting to more than a predetermined amount of colored data print, prior to a subsequent developing operation.

More specifically, a counter is provided in the colored print data measuring means which counts the colored print dot number in the print data for the respective colors, and blackened rates for respective colors are determined by calculating a total dot (pixel) number on the basis of a print area (paper size) of one page and the count value in the counter. Then, an agitation shortage of the developing powder in the respective developing powder containers is predicted beforehand based on the determined blackened rates, and when an agitation shortage of the developing powder is predicted for a specific developing powder container, the additional agitating operation controlling means is activated to increase the agitation of the developing powder in the specific developing powder container.

The colored print data measuring the means measures colored print data quantity in the print data for every printing operation of the print data and the additional agitating operation control means predicts a shortage of charge quantity of the developing powder caused by a toner supply of an amount consumed for developing the print data printings, and additionally activates the developing powder agitating means so as to prevent an occurrence of a charge quantity shortage.

DESCRIPTION OF A PREFERRED EMBODIMENT

Hereinbelow, an embodiment of the present invention is explained with reference to the drawings.

Figure 1:
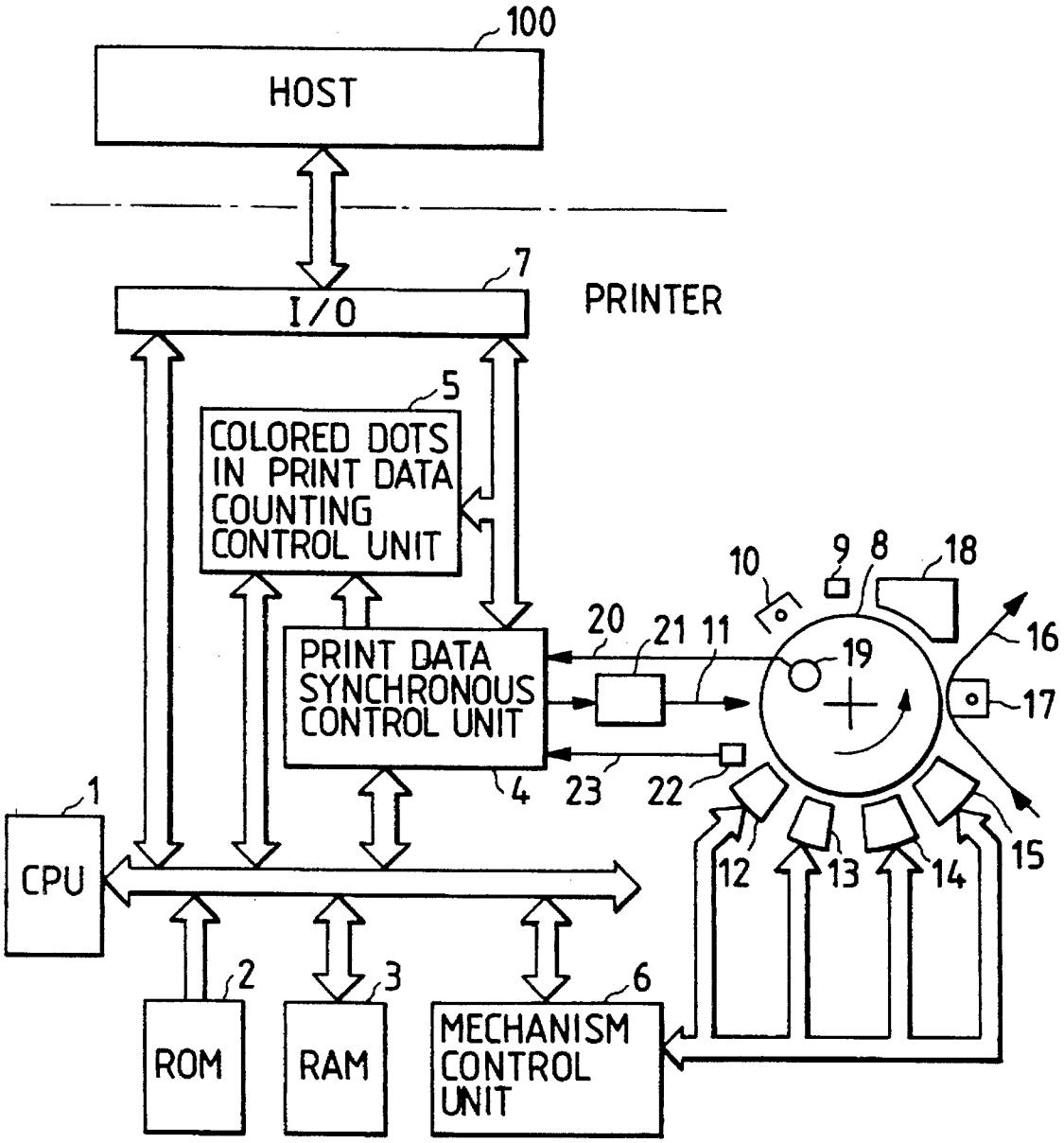
FIG. 1 is a block diagram of a color laser printer system according to the present invention.

FIG. 1 is a block diagram illustrating a color laser printer system according to the present invention. The color laser printer receives, via an input and output interface 7, print data from a host computer 100 of, such as a personal computer, a work station or a wordprocessor, and prints the same. The print data from the host computer 100 is transmitted in the form of video signals in synchronism with print data control timing signals produced from the printer side.

A CPU 1 serves for overall control of the printer and further controls input and output of signals to and from the host computer 100. A ROM 2 stores programs used for the control and processing executed by the CPU 1, and a RAM 3 is used as a memory for many kinds of parameters and data necessary when the CPU 1 executes processings according to the programs for control and processing as stored in the ROM 2. The input and output interface 7 inputs video signals sent from the host computer 100 for every color to be developed respectively to a print data synchronizing control unit 4 and a colored print data dot counting control unit 5. The print data synchronizing control unit 4 outputs video signals in a valid timing period of the video signals to an exposure control unit 21 with reference to a vertical reference position signal 20 from a photosensitive drum reference position sensor 19 and a horizontal reference position signal 23 from a horizontal position sensor 22. The exposure control unit 21 converts the input video signals into optical signals and outputs the same in the form of an exposure beam 11. The exposure beam 11 is deflected by a rotating polygon mirror (which will be explained later) which rotates stably at a high speed and is directed thereby onto a photosensitive drum 8 in its axial direction to form an electrostatic latent image thereon.

Figure 3:
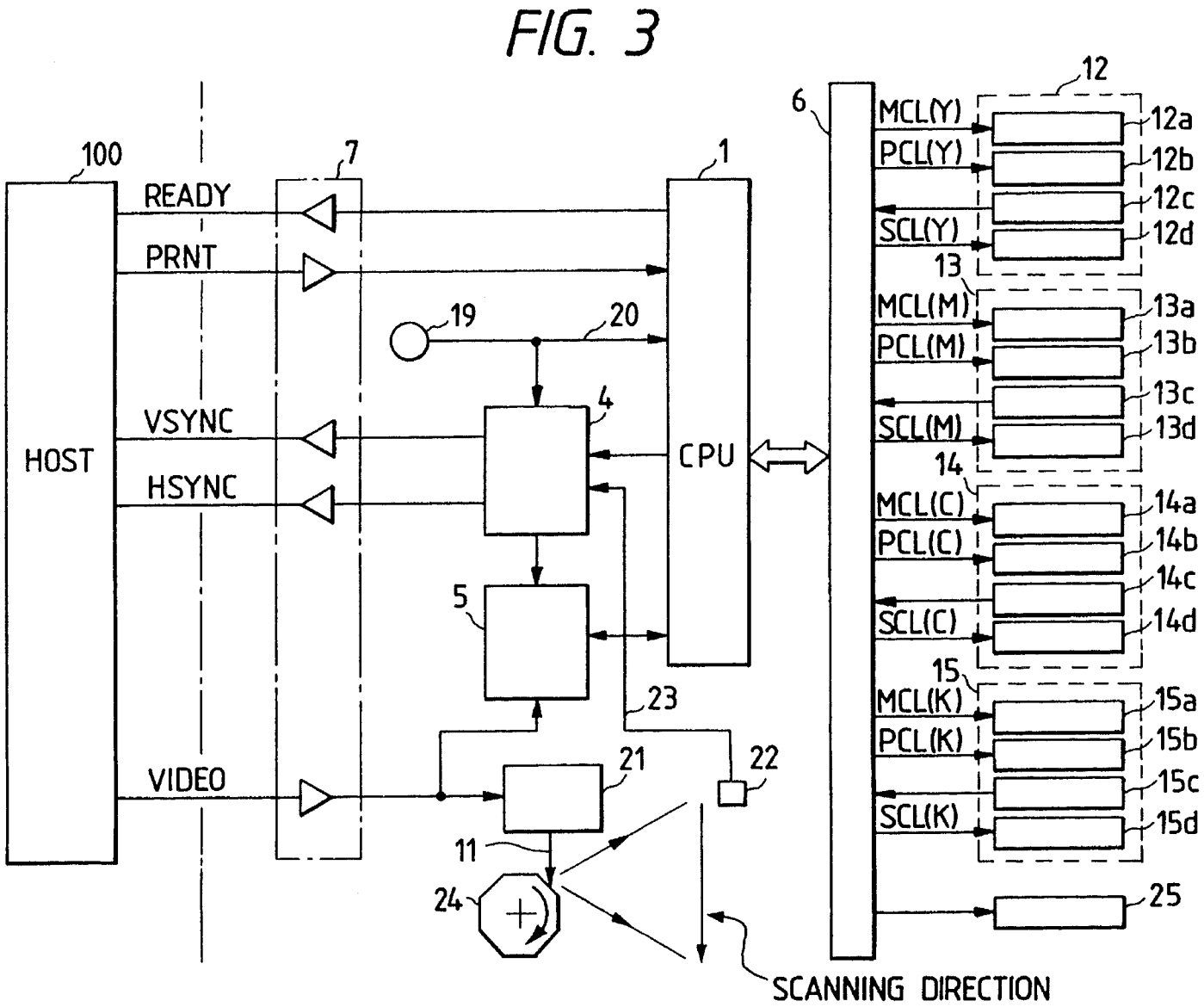
FIG. 3 is a block diagram-of a major portion of a control unit included in the color laser printer system according to the present invention.

On the other hand, the colored print data dot counting the control unit 5 counts colored print dot number in the video signals, with reference to signals such as HSYNC and VSYNC shown in FIG. 3 representing a valid video signal period and provided from the print data synchronizing control unit 4. Thereafter, the CPU 1 reads the colored print dot count value from the colored print data dot counting control unit 5.

Now, mechanisms which execute the electrophotographic processes and perform the printing operation will be explained. An electric charge eraser 9 neutralizes electric charges on the surface of the photosensitive drum 8 and thereby erases the same. An electric charger 10 subsequently uniformly charges the erased surface of the photosensitive drum 8. At a first rotation of the photosensitive drum 8, the exposure beam 11 controlled according to print data for the color yellow and generated from the exposure control unit 21 is directed onto the surface of the photosensitive drum 8 to form an electrostatic latent image thereon, and in response to the formed electrostatic latent image, the mechanism control unit 6 controls a yellow color developing unit 12 so as to act on the surface of the photosensitive drum 8 to develope the electrostatic latent image and then to form a yellow toner image thereon. At a second rotation of the photosensitive drum 8, the exposure beam 11 controlled according to print data for the color magenta and generated from the exposure control unit 21 is directed onto the surface of the photosensitive drum 8 to form an electrostatic latent image thereon, and in response to the formed electrostatic latent image, the mechanism control unit 6 controls a magenta color developing unit 13 so as to act on the surface of the photosensitive drum 8 to develope the electrostatic latent image and then to form a magenta toner image thereon.

Following thereto, at a third rotation of the photosensitive drum 8, an electrostatic latent image formed according to print data for the color cyan is developed with a cyan color developing unit 14 to form a cyan toner image thereon, and finally at a fourth rotation of the photosensitive drum 8, an electrostatic latent image formed according to print data for black is developed with a black color developing unit 15 to form a black toner image thereon. As a result, a resultant color toner image formed by superposing the four colored toner images is produced on the surface of the photosensitive drum 8.

Subsequently, a recording paper is fed onto a medium conveying path 16 in synchronism with the movement of the resultant color toner image and, when the recording paper is in contact with the surface of the photosensitive drum 8, the resultant color toner image is transferred onto the recording paper by means of an image transferring unit 17 through its charge transferring action. Thereafter, the color image is fixed on the recording paper by a fixing unit (not shown) to thereby complete a color picture image-print. Any remaining toner on the photosensitive drum 8 after completing transferring of the color toner image onto the recording paper is removed by a cleaner unit 18.

Now, the structure of the yellow color developing unit 12 through the black color developing unit 15 will be explained; however, since the structures of the respective color developing units are identical, only the structure of the yellow color developing unit 12 is explained hereinbelow.

Figures 2, 4:
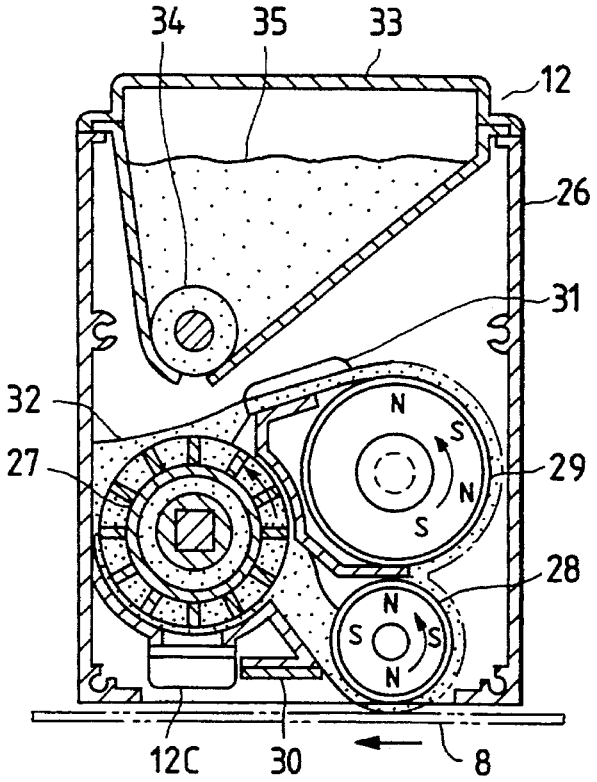
FIG. 2 is a vertically cross sectioned side view of one of the developing units included in the color laser printer system according to the present invention.
FIG. 4 is an explanatory view illustrating the content of an agitation control table incorporated in the control unit of the color laser printer system according to the present invention.

FIG. 2 is a vertically cross sectioned side view of the yellow color developing unit 12. The developing unit 12 is formed in a box shaped developing container by a developing unit frame 26 and both side plates (not shown). A paddle type agitating and conveying roller 27 having functions of agitating and conveying developing powder 32 is rotatingly driven in the arrowed direction. Through the rotation of the agitating and conveying roller 27, the developing powder 32 in the developing unit 12 is conveyed toward the left side of a developing magnet roller 28. The developing magnet roller 28 is rotatingly driven in the arrowed direction and conveys the developing powder 32 conveyed from the agitating and conveying roller 27 while attracting the same thereon. A doctor blade 30 limits the height of attracted and conveyed developing powder 32 on the surface of the developing magnet roller 28 to control the amount thereof.

The developing powder 32 attracted on the developing magnet roller 28 and conveyed therewith is brushed and aligned by the magnetic flux induced by the developing magnet roller 28 at the bottom portion thereof, and power contacts the surface of the photosensitive drum 8 to develope an electrostatic latent image formed on the surface thereof. A conveying magnet roller 29 receives the developing powder 32 from the developing magnet roller 28 which has passed through the developing surface and conveys the same, and a scraper 31 scrapes the developing powder 32 from the cenveying magnetic roller 29 and drops the same onto the agitating and conveying roller 27, so that the developing powder 32 is circulated in the developing unit 12, while being subjected to repeated mixing, agitating and developing.

In order to prevent the developing powder 32 from acting on the photosensitive drum 8 after completing the development of the electrostatic latent image formed according to the yellow color print data, the rotating drive of the developing magnet roller 28 and the conveying magnet roller 29 is continued for a predetermined interval after terminating the supply of the developing powder 32 onto the developing magnet roller 28 by interrupting the rotation of the agitating and conveying roller 27, with the result that the developing powder 32 is eliminated from both the developing magnet roller 28 and the conveying magnet roller 29 and the action of the developing powder 32 on the photosensitive drum 8 is prevented.

A toner density detecting unit 12*c* outputs an electrical signal corresponding to a toner density in the developing powder 32 conveyed by the rotation of the agitating and conveying roller 27. Only the electrical signals from the toner density detecting unit 12*c* outputted when the developing powder 32 is circulated in the developing unit 12 via the rotating drive of the agitating and conveying roller 27, the developing magnet roller 28 and the conveying magnet roller 29 are used as valid signals.

In a toner cartridge 33, a supply roller 34 and toner 35 are provided; and, through the rotating drive of the supply roller 34, the toner 35 is supplied into the developing powder container.

FIG. 3 is a block diagram of a major portion of a control unit for detecting a blackened rate of print data and for controlling the toner supply and the developing powder agitation.

At first, the interface portion of the host computer 100 is explained.

The print data synchronizing control unit 4 generates horizontal synchronizing signals HSYNC determining a printing region and a timing in the horizontal direction with reference to the horizontal reference position signal 23 which is generated at the moment when the horizontal position sensor 22, located at a horizontal reference position detects passage of the exposure beam 11 therethrough, which is repeadedly deflected by a rotating polygon mirror 24, and transmits the horizontal synchronizing signals HSYNC to the host computer 100 via the input and output interface 7. Further, the print data synchronizing control unit 4 generates vertical synchronizing signals VSYNC having a time width corresponding to the length of a recording paper in the conveying direction with reference to the vertical reference position signal 20 which is generated at the moment when the reference position of the stably rotating photosensitive drum 8 passes through the photosensitive drum reference position sensor 19, and by making use of the horizontal reference position signals as a clock, and transmits the vertical synchronizing signals VSYNC to the host computer 100 via the input and output interface 7.

The host computer 100 generates video signals VIDEO in synchronism with the horizontal synchronizing signals HSYNC and the vertical synchronizing signals VSYNC and transfers the video signals VIDEO via the input and output interface 7 to the colored print data dot counting control unit 5, as well as to the exposure control unit 21.

Now, the blackened rate of the print data will be explained hereinbelow.

In the course of data printing, the host computer 100 transmits print command signals PRNT including information relating to the size the print region (print paper size information). Accordingly, the CPU 1 can determine the total dot (pixel) number of the print paper based on the paper size information. For example, when total dot numbers for many kinds of paper sizes are beforehand stored in the ROM 2, a corresponding total dot number is determined by reading out the stored number in the ROM 2 based on the paper size information from the host computer 100. The colored print dot number for every color is determined via counting in the colored print data dot counting control unit 5. A blackened rate of print data for every color is expressed as:

(colored print dot number in entire print region)÷(total dot number in entire print region)

The calculation of the above is executed in the CPU 1 by making use of its processing function.

The agitating and conveying roller 27, the developing magnet roller 28, the convering magnet roller 29 and the supply roller 34 are designed to be driven by a developing motor through respective clutches. The developing motor 25 is continuously kept in a rotating condition after the color laser printer is turned on. Clutches for the agitating and conveying rollers (12*b* for the yellow color developing unit, 13*b* for the magenta color developing unit, 14*b* for the cyan color developing unit and 15*b* for the black color developing unit), clutches for the developing and conveying magnet rollers (12*a* for the yellow color developing unit, 13*a* for the magenta color developing unit, 14*a* for the cyan color developing unit and 15*a* for the black color developing unit) and clutches for the supply rollers (12*d* for the yellow color developing unit, 13*d* for the magenta color developing unit, 14*d* for the cyan color developing unit and 15*d* for the black color developing unit) are selectively coupled and decoupled in response to control signals PCL(Y), PCL(M), PCL(C) and PCL(K) for the agitating and conveying roller clutches, MCL(Y), MCL(M), MCL(C) and MCL(K) for the developing and conveying magnet roller clutches, and SCL(Y), SCL(M), SCL(C) and SCL(K) for the supply roller clutches provided to the mechanism control unit 6, and the respective rollers are selectively driven by making use of the single developing motor 25 as the driving source.

FIG. 4 is a table for an agitation control showing a relationship between blackened rate for every color and forced agitation. At the time when the power source of the printer is turned on, the initial value of the counters for the forced agitation control for every color are set to "0". After transmitting the print command signal PRNT, the host computer 100 transmits print data for every color. The CPU 1 for the printer calculates a blackened rate or colored rate in print data for every color every time the input of the print data for respective colors is completed. A renewed value in the table for agitation control of the counter for forced agitation for a specific color is added to the storage value thereof based on the calculated blackened rate and the sum thereof is restored in the counter for forced agitation control for the specific color. When an accumulated value of the counter for forced agitation exceeds "4", an agitating operation is additionally performed for the corresponding developing unit in which counter accumulated value has exceeded "4" after completing the printing sequence for the object recording paper. Further, when it is detected that the toner density for a specific developing unit is reduced below a predetermined level, the toner is supplied to the specific developing unit during an additional agitating operation thereof.

After completing an additional agitation of the developing powder for a specific color, the corresponding counter for agitation control for the developing unit for the specific color is reset to "0". Further, when accumulated values of a plurality of counters for agitation control for respective developing units for different colors exceed "4" at the same time, an additional agitating operation is applied for the respective developing units for the different colors.

Figure 5:
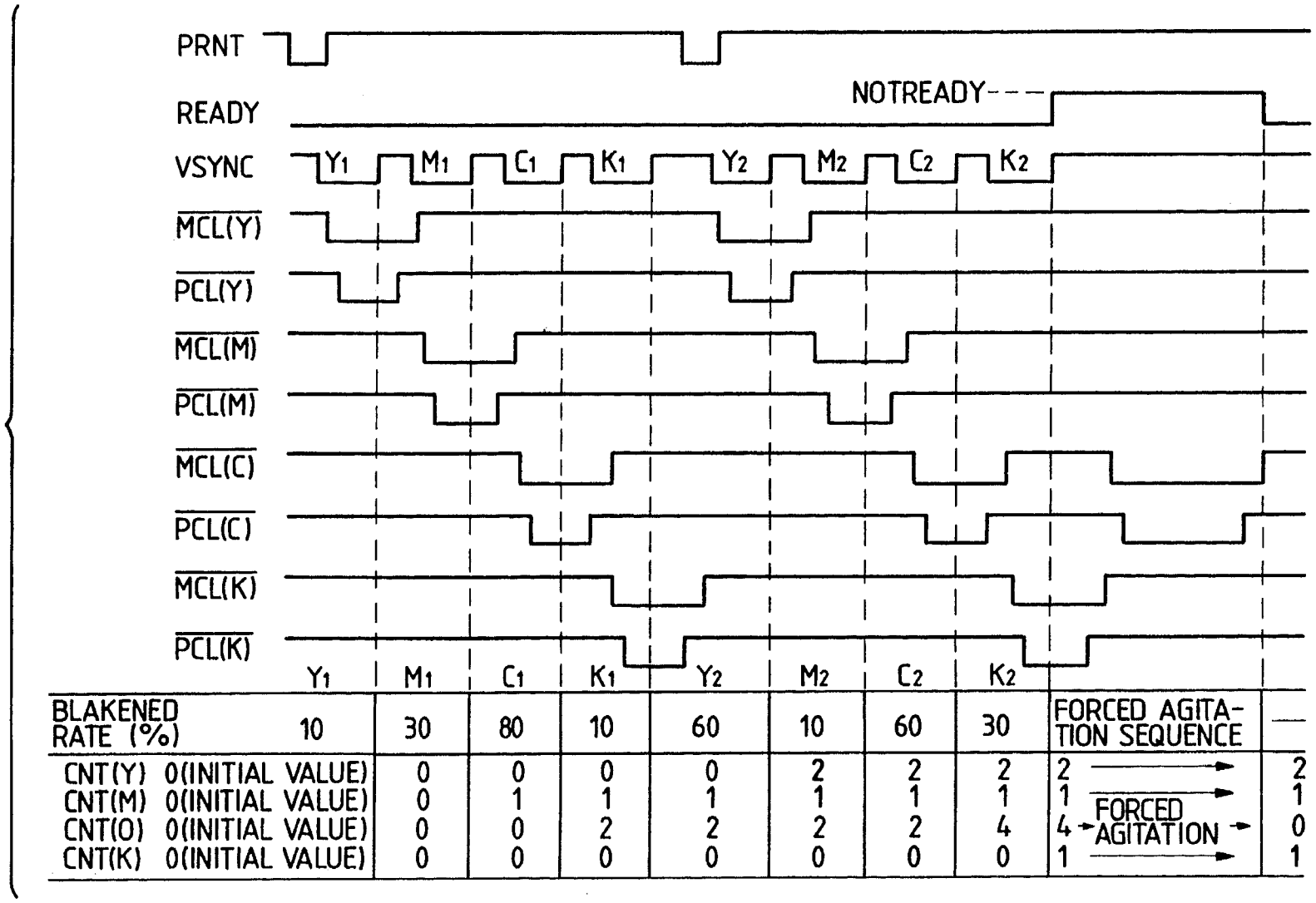
FIG. 5 is a timing chart of a forced agitation sequence executed by the control unit of the color laser printer system according to the present invention.

FIG. 5 shows a timing chart of a print control and a developing powder agitation control when the printer has twice received print commands of a four color picture image from the host computer 100. A print command signal PRNT for printing data of respective colors is provided from the host computer 100. A print permitting signal READY is a signal representing that the printer is ready for printing and is to be transmitted to the host computer 100. The vertical synchronizing signals VSYNC indicate that the printing data is received in the order of $Y_1$, $M_1$, $C_1$, $K_1$, $Y_2$, $M_2$, $C_2$ and $K_2$ and the blackened rates of the respective print data in the present example are indicated as 10, 30, 80, 10, 60, 10, 60, 30%. Wherein $Y_1$ and $Y_2$ represent print data for the color yellow $M_1$ and $M_2$ represent print data for the color magenta $C_1$ and $C_2$ represent print data for the color cyan and $K_1$ and $K_2$ represent print data for black. CNT(Y), CNT(M), CNT(C) and CNT(K) respectively represent accumulated counter values of counters for forced agitation control for yellow, magenta, cyan and black. Every time after termination of the vertical synchronizing signals VSYNC, the counter values of the respective counters for forced agitation control are renewed according to the table for agitation control, as shown in FIG. 4, with reference to the respective blackened rates calculated in the CPU 1. As seen from the variation of the counter values of the respective counters for agitation control illustrated at the bottom of FIG. 5, a condition for shifting to a forced agitation sequence according to the schedule in the table for agitation control is fulfilled after completing the reception of the cyan color print data $C_2$ in the second time print command signal and then the count value of the counter for agitation control for the cyan color developing unit is renewed. Accordingly, the CPU 1 inverts the print permitting signal READY and displays a print inhibiting condition after completing reception of print data for all colors in the second time print command signal, in other words, after completing reception of the second time black color print data $K_2$, and a forced agitation sequence for the cyan color developing unit 14 is performed. After completing the forced agitation sequence, the counter value of the counter for forced agitation control for the cyan color developing unit 14 is initialized, in that, it is set at "0" and the print permitting signal READY is restored to a print permitting condition.

Figure 6:
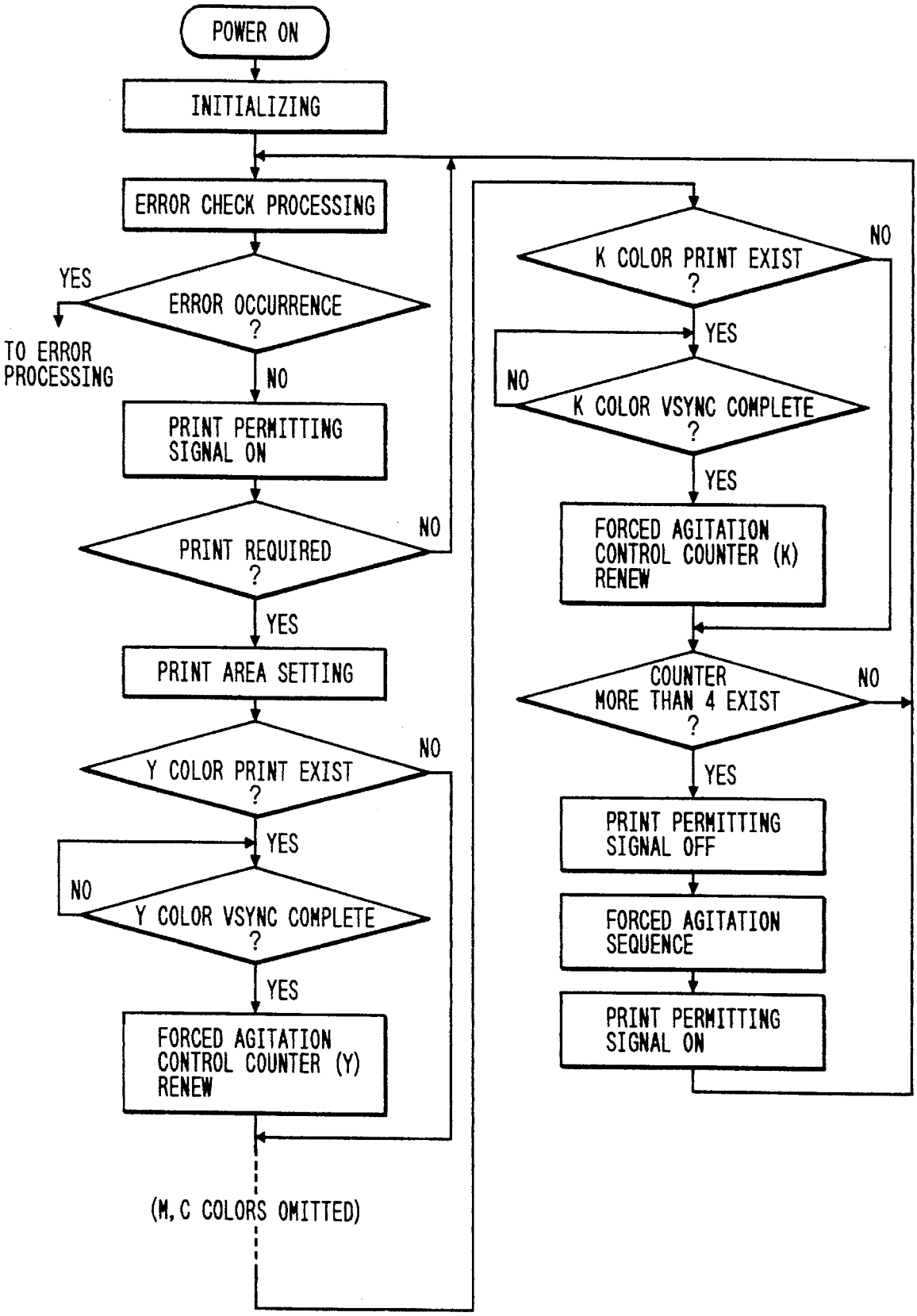
FIG. 6 is a flow chart of controlling processes executed in a CPU incorporated in the control unit of the color laser printer system according to the present invention.

FIG. 6 shows a flow chart of controlling processes executed by the CPU 1.

When the power source of the printer is turned on, the CPU 1 initializes the I/O of its control object, i.e., the mechanism control unit 6, and the interface control unit 7 with the host computer 100 and performs a preprocessing for receiving a print command from the host computer 100, and then waits. Further, the CPU 1 always monitors the operation for any; and abnormality in the printer and when any abnormality is detected, a proper counter measuring processing for the detected abnormality is executed, although the illustration of this is omitted from the flow chart in FIG. 6.

Immediately after receiving the print command signal PRNT from the host computer 100, the process moves to the printing sequence and performs a preparation process for producing an electrostatic latent image on the photosensitive drum 8. After confirming that a timing for forming an electrostatic latent image on the photosensitive drum 8 has been reached with reference to the vertical reference position signal 20 from the photosensitive drum reference position sensor 19, the print data synchronizing control unit 4 is caused to generate a horizontal synchronizing signal HSYNC and a vertical synchronizing signal VSYNC and to transmit the same to the host computer 100. Then, in response thereto, the host computer 100 is caused to transfer video signals VIDEO to perform the controlling processing for the print data for respective colors. In the flow chart of the controlling processes shown in FIG. 6, the illustration of the controlling processes for the developing stage and the image transferring stage are omitted and only those in the electrostatic latent image producing stage are illustrated.

During the data printing operation for printing respective colors, more specifically, during electrostatic latent image production of the respective colors, the colored print dot number in the corresponding color print data is read out from the colored print data dot counting control unit 5 at the moment when the respective vertical synchronizing signals VSYNC have been terminated, and the count values of the counters for the agitation control for respective colors are renewed with reference to the table for agitation control, as shown in FIG. 4. After completing the reception of the respective video signals for yellow, magenta, cyan and black, the counter values of the counters for agitation control for the respective colors are checked and when a counter having count values exceeding "4" is detected, the process moves to the forced agitation sequence for the corresponding developing unit. Since, during execution of the forced agitation control sequence, a subsequent data printing operation can not be performed, the print permitting signal READY is inverted and the printing disabling condition is transmitted to the host computer 100. Then the forced agitation sequence is executed. After completing the forced agitation sequence, the print permitting signal READY is changed to a level representing the print enabling condition, if no abnormality exists.

According to the present invention, a colored print data quantity in print data for a specific color is measured with the colored print data measuring means every time the print data is to be printed, a shortage of charging quantity of the developing powder caused by toner supply due to toner consumption via the corresponding data printing is predicted by the additional agitation control means and the developing powder agitating means is additionally activated so as not to cause a shortage of the charging quantity of the developing powder. As a result, even with a small sized color electrophotographic device having small size and light weight developing units, a shortage of charging quantity of the developing powder caused by toner supply, which is necessitated by frequent printing of print data having a higher blackened rate, is prevented, with the result that a high quality color picture image printing is realized while suppressing a printing speed reduction as much as posible.

We claim:

1. An electrophotographic device comprising:

a photosensitive body on which electrostatic latent images are formed according to print data for images;

a developing unit including a developing powder container accommodating a developing powder containing toners, a developing powder agitating means for agitating the developing powder, and a toner supplying means for supplying the toners in said developing powder container;

a developing unit activating means for activating said developing unit to develop the electrostatic latent image formed on said photosensitive body; and a control unit for controlling said developing powder agitating means, said toner supplying means and said developing unit activating means, said control unit including a print data measuring means which measures a single color print data quantity in print data and an additional agitation control means which additionally activates said developing powder agitating means prior to a developing operation for said developing unit which has experienced developing of electrostatic latent images formed with the single color print data in a quantity which exceeds a predetermined quantity.

2. An electrophotographic device according to claim 1, wherein said print data measuring means includes a single color print dot counting means which counts single color print dot numbers in print data and said additional agitation control means operates to additionally activate said developing powder agitating means prior to a subsequent developing operation for said developing images formed with a single color print dot number exceeding said predetermined quantity determined by said single color print dot counting means.

3. An electrophotographic device according to claim 2, wherein said control unit includes means for inhibiting the developing operation during the additional agitating operation of the developing powder.

4. An electrophotographic device according to claim 1, wherein said additional agitation control means includes a table in which a single color print data rate for print data is divided into a plurality of regions depending on the magnitude of the single color print data rate, the respective divided regions, each covering a predetermined single color print data rate, are allocated predetermined weights depending on the magnitude of the covering single color print data rate, and wherein said additional agitation control means includes means for calculating an accumulated weight for said developing unit with reference to said table every time a developing operation of the electrostatic latent image on said photosensitive body is completed and for additionally activating said developing powder agitating means for said developing unit of which the calculated accumulated weight exceeds a predetermined value.

5. An electrophotographic device according to claim 4, wherein said single color print data rate in print data in said table is divided into first, second and third regions, wherein the first region covers a single color print data rate 0–29% and is allocated a first weight of 0, the second region covers a single color print data rate of 30–49% and is allocated a second weight of 1, and the third region covers a single color print data rate of 50–100% and is allocated a third weight of 2, and the predetermined value of the accumulated weight which initiates the additional activation of said developing powder agitating means for said developing unit is determined at 4.

6. An electrophotographic device according to claim 4, wherein said control unit includes means for inhibiting the developing operation during the additional agitating operation of the developing powder.

7. An electrophotographic device according to claim 1, wherein said control unit includes means for inhibiting the developing operation during the additional agitating operation of the developing powder.

8. An electrophotographic device according to claim 1, wherein the single color is a black color.

* * * * *